US007766438B2

(12) United States Patent
Ehlert

(10) Patent No.: US 7,766,438 B2
(45) **Date of Patent: *Aug. 3, 2010**

(54) METHOD OF INK EVAPORATION PREDICTION FOR AN INK RESERVOIR

(75) Inventor: Jeffrey Ray Ehlert, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1162 days.

This patent is subject to a terminal disclaimer.

(21) Appl. No.: 10/861,945

(22) Filed: Jun. 4, 2004

(65) Prior Publication Data

US 2005/0270314 A1 Dec. 8, 2005

(51) Int. Cl.
*B41J 2/195* (2006.01)
*B41J 29/38* (2006.01)

(52) U.S. Cl. ..... 347/7; 347/6

(58) Field of Classification Search ..... 347/6, 347/7

See application file for complete search history.

(56) References Cited

U.S. PATENT DOCUMENTS

| | | | | |
|---|---|---|---|---|
| 4,432,005 | A | 2/1984 | Duffield et al. | 346/140 |
| 5,068,806 | A | 11/1991 | Gatten | 395/113 |
| 5,414,452 | A * | 5/1995 | Accatino et al. | 347/7 |
| 5,459,556 | A | 10/1995 | Acquaviva et al. | 355/209 |
| 5,655,174 | A | 8/1997 | Hirst | 399/27 |
| 5,721,573 | A | 2/1998 | Benjamin | 347/7 |
| 5,758,224 | A | 5/1998 | Binder et al. | 399/25 |
| 5,794,094 | A | 8/1998 | Boockholdt et al. | 399/27 |
| 5,797,061 | A | 8/1998 | Overall et al. | 399/27 |
| 5,802,420 | A | 9/1998 | Garr et al. | 399/27 |
| 5,826,134 | A | 10/1998 | Hino et al. | 399/27 |
| 5,937,225 | A | 8/1999 | Samuels | 399/27 |
| 5,950,043 | A | 9/1999 | Fujita et al. | 399/60 |
| 5,970,275 | A | 10/1999 | Brown, Jr. et al. | 399/27 |
| 6,052,547 | A | 4/2000 | Cuzzo et al. | 399/79 |
| 6,116,715 | A | 9/2000 | Lefebvre et al. | 347/19 |
| 6,151,039 | A | 11/2000 | Hmelar et al. | 347/7 |
| 6,196,651 | B1 | 3/2001 | Zuber et al. | 347/7 |
| 6,299,277 | B1 | 10/2001 | Fujii | 347/23 |
| 6,360,174 | B1 | 3/2002 | Shoki | 702/55 |
| 6,382,858 | B1 * | 5/2002 | Nojima et al. | 400/691 |
| 6,397,015 | B2 | 5/2002 | Currey et al. | 399/12 |
| 6,431,673 | B1 | 8/2002 | Heim et al. | 347/9 |
| 6,456,802 | B1 | 9/2002 | Phillips | 399/27 |
| 6,476,837 | B2 | 11/2002 | Ogata | 347/140 |
| 6,494,553 | B1 | 12/2002 | Donahue et al. | 347/7 |
| 6,523,947 | B2 | 2/2003 | Koga et al. | 347/100 |
| 6,561,622 | B1 | 5/2003 | Suzuki et al. | 347/35 |
| 6,568,780 | B2 | 5/2003 | Schantz et al. | 347/14 |
| 6,837,562 | B2 * | 1/2005 | Nunokawa | 347/14 |
| 6,871,926 | B2 * | 3/2005 | Adkins et al. | 347/7 |
| 2002/0037173 | A1 | 3/2002 | Kakeshita | 399/27 |
| 2002/0127024 | A1 | 9/2002 | Matsumoto et al. | 399/27 |
| 2002/0149655 | A1 * | 10/2002 | Kurata et al. | 347/86 |
| 2003/0020773 | A1 * | 1/2003 | Schantz et al. | 347/14 |
| 2003/0030683 | A1 | 2/2003 | Nojima | 347/7 |
| 2003/0161642 | A1 | 8/2003 | Ohkubo | 399/27 |
| 2003/0165344 | A1 | 9/2003 | Ohtomo et al. | 399/27 |

* cited by examiner

*Primary Examiner*—Julian D Huffman
*Assistant Examiner*—Jason S Uhlenhake

(57) ABSTRACT

A method of ink evaporation prediction for an ink reservoir includes establishing an empirical evaporation curve representing evaporation characteristics for an ink reservoir type, the ink reservoir belonging to the ink reservoir type; and establishing an evaporation prediction curve for the ink reservoir that approximates the empirical evaporation curve.

20 Claims, 5 Drawing Sheets

METHOD OF INK EVAPORATION PREDICTION FOR AN INK RESERVOIR

BACKGROUND OF THE INVENTION

1. Field of the invention.

The present invention relates to determining an amount of ink depleted from an ink reservoir, and, more particularly, to a method of ink evaporation prediction for an ink reservoir.

2. Description of the related art.

Ink jet disposable printhead cartridges include an ink reservoir that contains ink that is used to print on a print medium, such as paper. Typically, the ink level indicators on the printer in the Windows driver can keep track of the ink level based on counting the ink drops jetted on the print medium. In addition, the drops jetted during a printhead maintenance operation can be tracked as well. However, ink volume losses can occur in ways that cannot be tracked by only counting jetted ink dots. As used herein, the terms "ink dots" and "ink drops" are synonymous.

For example, it has been recognized that a significant loss of ink volume in a printhead cartridge can occur through evaporation. The evaporation occurs, for example, through the vent in the cartridge lid, through the nozzle openings in the printhead nozzle plate (even when capped), through the plastic cartridge body and through the cap seals. The loss rate depends, for example, on temperature and humidity, as well as the construction of the lid vent, cartridge material, etc.

What is needed in the art is a method of ink evaporation prediction for an ink reservoir.

SUMMARY OF THE INVENTION

The present invention provides a method of ink evaporation prediction for an ink reservoir.

The invention, in one form thereof, is directed to a method that establishes an empirical evaporation curve representing evaporation characteristics for an ink reservoir type, the ink reservoir belonging to the ink reservoir type; and establishes an evaporation prediction curve for the ink reservoir that approximates the empirical evaporation curve.

In another form thereof, the invention is directed to a method of ink evaporation prediction for an ink reservoir having ink evaporation characteristics represented by an empirical evaporation curve determined for an ink reservoir type, the ink reservoir belonging to the ink reservoir type, the method associating a respective rate of evaporation to each of a plurality of time segments associated with the empirical evaporation curve, the respective rate of evaporation being based on a respective approximation algorithm associated with each of the plurality of time segments.

In still another form thereof, the invention is directed to a printhead comprising memory. The memory stores parameters associated with an evaporation prediction curve for an ink reservoir that approximates an empirical evaporation curve. A printer in which the printhead is installed executes instructions to: determine an evaporation amount based on the evaporation prediction curve for the ink reservoir; and use the evaporation amount to compensate for an evaporation loss for the ink reservoir by adjusting a cumulative actual ink drop count to form an evaporation compensated drop count.

An advantage of certain embodiments of the present invention is that the method of ink evaporation prediction for an ink reservoir, such as for example, an ink reservoir associated with an ink jet printhead cartridge, tracks an empirically modeled evaporation profile established for a particular ink reservoir type to which the ink reservoir belongs, thereby permitting evaporation compensation from a time of initial ink reservoir fill to the time of complete exhaustion of the usable ink in the ink reservoir.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
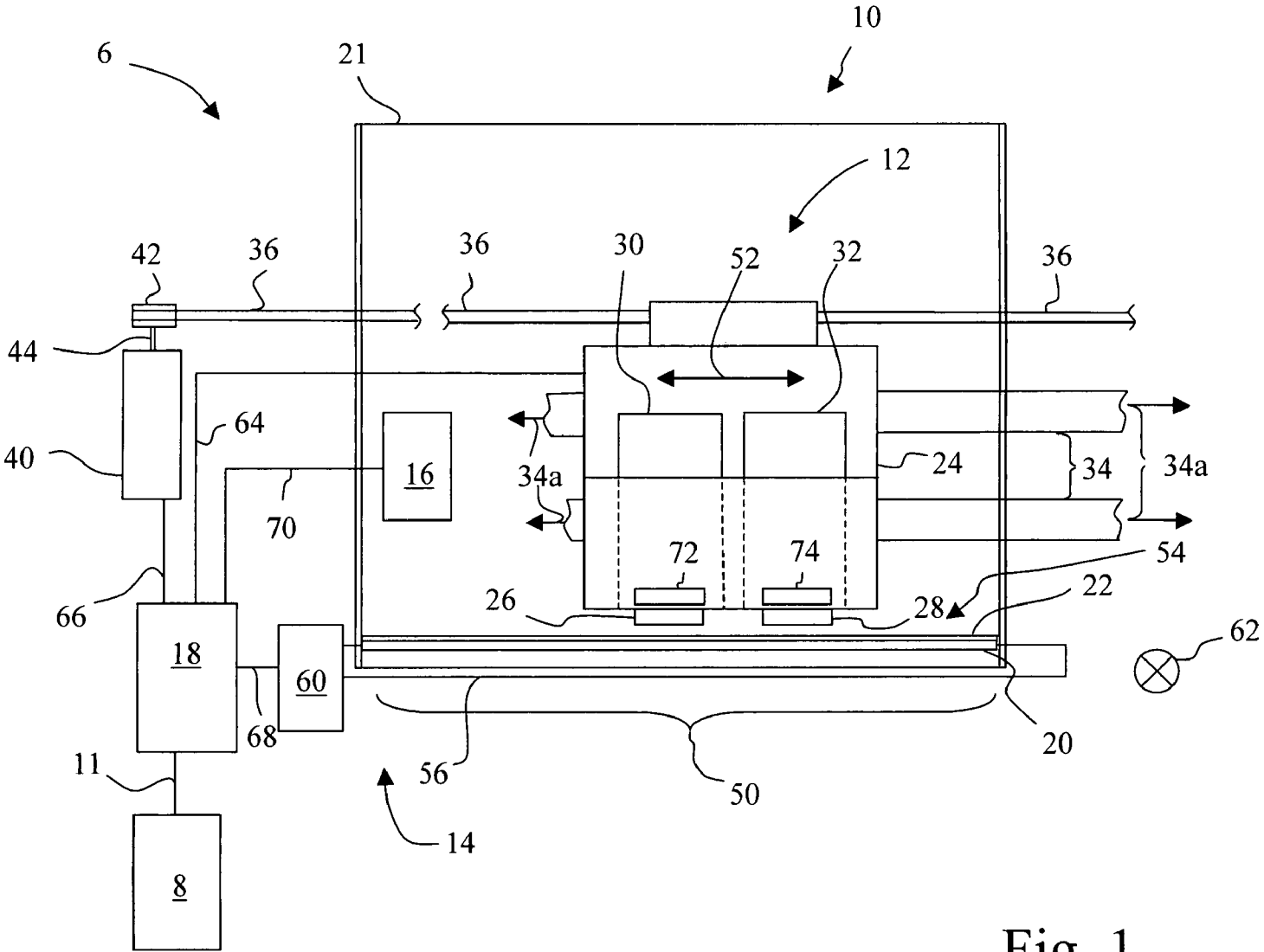
FIG. 1 is an imaging system embodying the present invention.

Referring now to the drawings, and particularly to FIG. 1, there is shown an imaging system 6 embodying the present invention. Imaging system 6 may include a host 8, or alternatively, imaging system 6 may be a standalone system.

Imaging system 6 includes an imaging apparatus 10, which may be in the form of an ink jet printer, as shown. Thus, for example, imaging apparatus 10 may be a conventional ink jet printer, or may form the print engine for a multi-function apparatus, such as for example, a standalone unit that has faxing and copying capability, in addition to printing.

Host 8, which may be optional, may be communicatively coupled to imaging apparatus 10 via a communications link 11. Communications link 11 may be, for example, a direct electrical connection, a wireless connection, or a network connection.

In an embodiment including host 8, host 8 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, host 8 may include in its memory a software program including program instructions that function as a printer driver for imaging apparatus 10. The printer driver is in communication with imaging apparatus 10 via communications link 11. The printer driver, for example, may include a halftoning unit and a data formatter that places print data and print commands in a format that can be recognized by imaging apparatus 10. In a network environment, communications between host 8 and imaging apparatus 10 may be facilitated via a standard communication protocol, such as the Network Printer Alliance Protocol (NPAP). The NPAP includes a multitude of predefined Network Printer Alliance (NPA) commands, and facilitates the generation of new NPA commands.

In the embodiment of FIG. 1, imaging apparatus 10 includes a printhead carrier system 12, a feed roller unit 14, a sheet picking unit 16, a controller 18, a mid-frame 20 and a media source 21.

Media source 21 is configured to receive a plurality of print media sheets from which an individual sheet of print media 22 is picked by sheet picking unit 16 and transported to feed roller unit 14, which in turn further transports print media sheet 22 during a printing operation. The sheet of print media 22 may be, for example, plain paper, coated paper, photo paper and transparency media.

Printhead carrier system 12 includes a printhead carrier 24 for carrying a color printhead 26 and/or a monochrome printhead 28. A color ink reservoir 30 is provided in fluid communication with color printhead 26, and a monochrome ink reservoir 32 is provided in fluid communication with monochrome printhead 28. Those skilled in the art will recognize that color printhead 26 and color ink reservoir 30 may be formed as individual discrete units, or may be combined as an integral unitary printhead cartridge. Likewise, monochrome printhead 28 and monochrome ink reservoir 32 may be formed as individual discrete units, or may be combined as an integral unitary printhead cartridge.

The amount of available ink in an ink reservoir, such as for example, color ink reservoir 30 or monochrome ink reservoir 32, when initially filled with ink, and prior to any evaporation, is referred to as the total yield, T0 Yield, of the ink reservoir. T0 Yield may be represented, for example, by an ink drop count, which in turn may be correlated to an approximate page count, if desired. An amount of ink depleted from the ink reservoir may be determined, for example, by counting the number of ink drops expelled from the ink reservoir by the associated printhead, and by compensating for ink evaporation losses, regardless of whether any ink was expelled from the ink reservoir during a printing or maintenance operation.

Printhead carrier 24 is guided by a pair of guide members 34, which may be, for example, in the form of guide rods, guide channels, or a combination thereof. The axes 34*a* of guide members 34 define a bi-directional scanning path for printhead carrier 24, and thus, for convenience the bi-directional scanning path may be referred to as bi-directional scanning path 34*a*. Printhead carrier 24 is connected to a carrier transport belt 36 that is driven by a carrier motor 40 via carrier pulley 42. Carrier motor 40 has a rotating carrier motor shaft 44 that is attached to carrier pulley 42. At the directive of controller 18, printhead carrier 24 is transported in a reciprocating manner along guide members 34. Carrier motor 40 may be, for example, a direct current (DC) motor or a stepper motor.

The reciprocation of printhead carrier 24 transports ink jet printheads 26, 28 across the sheet of print media 22, such as paper, along bi-directional scanning path 34*a* to define a print zone 50 of imaging apparatus 10. The reciprocation of printhead carrier 24 occurs in a main scan direction 52 that is parallel with bi-directional scanning path 34*a*, and is also commonly referred to as the horizontal direction. During each scan of printhead carrier 24 during printing, the sheet of print media 22 is held stationary by feed roller unit 14.

Mid-frame 20 provides support for the sheet of print media 22 when the sheet of print media 22 is in print zone 50, and in part, defines a portion of a print media path 54 of imaging apparatus 10.

Feed roller unit 14 includes an index roller 56 and corresponding index pinch rollers (not shown). Index roller 56 is driven by a drive unit 60. The index pinch rollers apply a biasing force to hold the sheet of print media 22 in contact with respective driven index roller 56. Drive unit 60 includes a drive source, such as a stepper motor, and an associated drive mechanism, such as a gear train or belt/pulley arrangement. Feed roller unit 14 feeds the sheet of print media 22 in a sheet feed direction 62, designated as an X in a circle to indicate that the sheet feed direction is out of the plane of FIG. 1 toward the reader.

Controller 18 includes a microprocessor having an associated random access memory (RAM) and read only memory (ROM). Controller 18 executes program instructions to effect the printing of an image on the sheet of print media 22, and executes further instructions to communicate with and monitor the operations of printheads 26, 28. Controller 18 is electrically connected and communicatively coupled to printheads 26, 28 via a communications link 64, such as for example a printhead interface cable. Controller 18 is electrically connected and communicatively coupled to carrier motor 40 via a communications link 66, such as for example an interface cable. Controller 18 is electrically connected and communicatively coupled to drive unit 60 via a communications link 68, such as for example an interface cable. Controller 18 is electrically connected and communicatively coupled to sheet picking unit 16 via a communications link 70, such as for example an interface cable.

As an example, one of color printhead 26 and color ink reservoir 30 may have attached thereto a memory 72 for storing information relating to color printhead 26 and/or color ink reservoir 30, such as for example, an identification number, a value representing an amount of usage of color printhead 26 and/or color ink reservoir 30, and one or more values representing time. Memory 72 may be, for example, a one time programmable memory. For example, memory 72 may be formed integral with other electrical components on the silicon of color printhead 26. Color printhead 26 may be configured to eject a single color of ink, or may be configured to eject multiple colors of ink, such as for example, two or more combinations of various colors of ink, e.g., black, cyan, magenta, yellow, diluted colors, orange, green and any other colors known in the art. Color ink reservoir 30 may be configured to carry a single color of ink, or may be configured to carry multiple colors of ink, such as for example, two or more combinations of various colors of ink, e.g., black, cyan, magenta, yellow, diluted colors, orange, green and any other colors known in the art. Controller 18 communicates with memory 72 via communications link 64.

Also, one of monochrome printhead 28 and monochrome ink reservoir 32 may have attached thereto a memory 74 for storing information relating to monochrome printhead 28 and/or monochrome ink reservoir 32, such as for example, a supply item identification number, a value representing an amount of usage of monochrome printhead 28 and/or monochrome ink reservoir 32, and one or more values representing time. Memory 74 may be, for example, a one time programmable memory. For example, memory 74 may be formed integral with other electrical components on the silicon of monochrome printhead 28. Controller 18 communicates with memory 72 via communications link 64.

Figure 2:
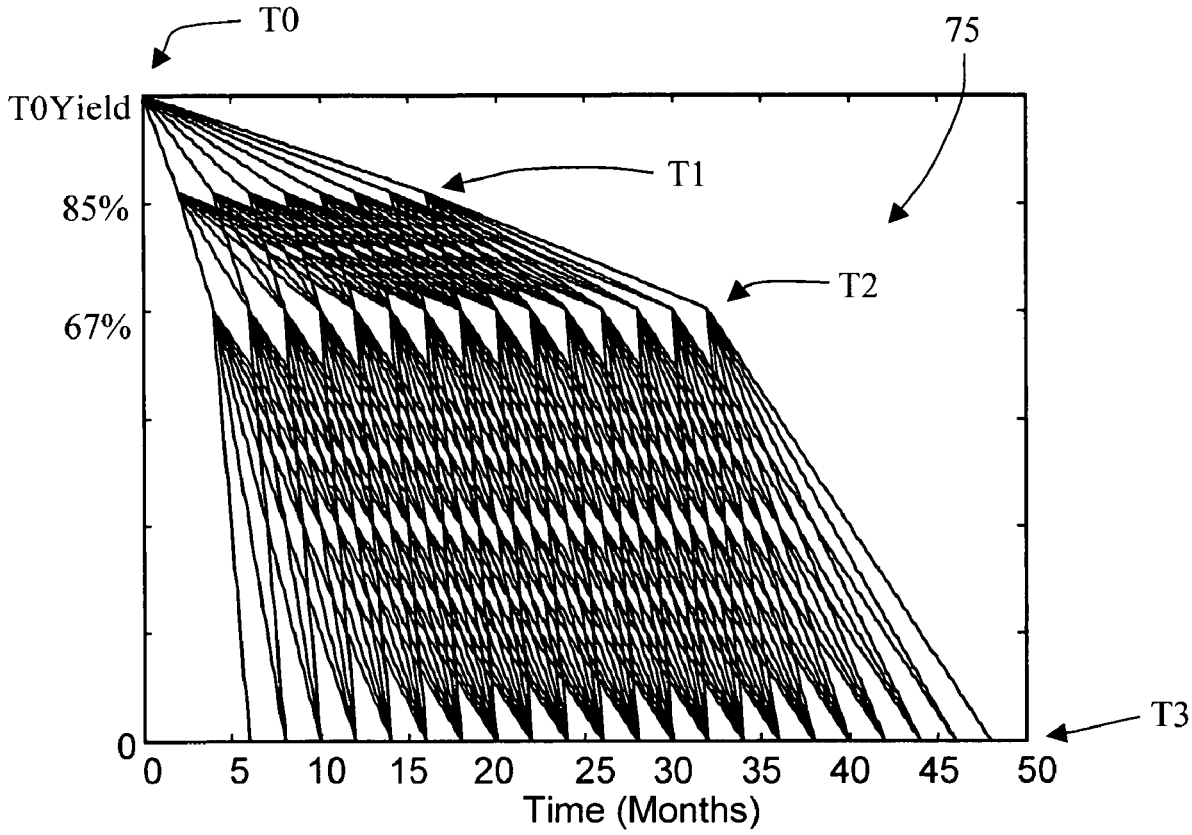
FIG. 2 depicts a plurality of evaporation prediction curves established in accordance with an embodiment of the present invention and based on a plurality of combinations of parameters that may be stored in a memory associated with a particular ink reservoir.
Figure 3:
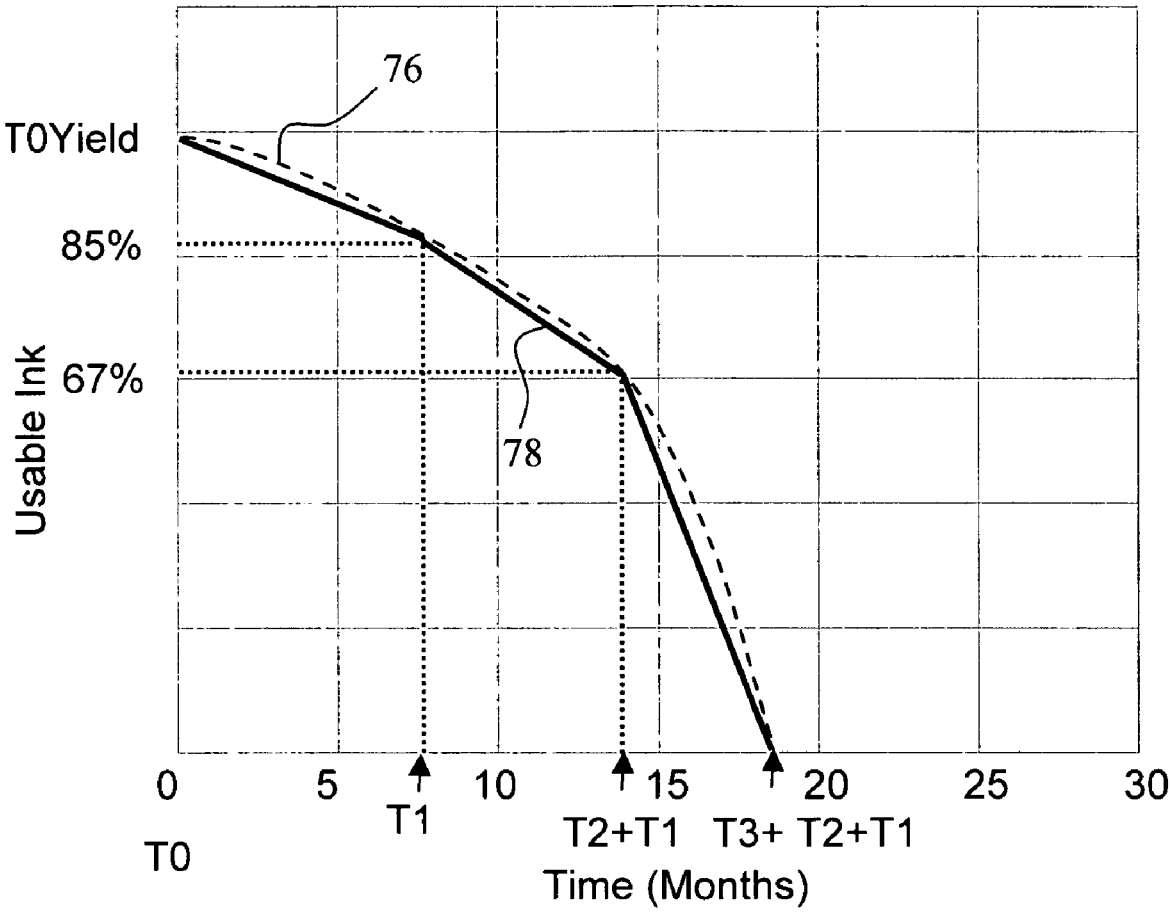
FIG. 3 depicts an empirical evaporation curve representing evaporation characteristics associated with a particular type of ink reservoir, and an exemplary evaporation prediction curve established in accordance with an embodiment of the present invention.

FIGS. 2 and 3 are graphical depictions of evaporation curves established and/or used in accordance with embodiments of the present invention.

FIG. 2 shows a plurality of evaporation prediction curves 75 generated in accordance with embodiments of the present invention. The evaporation prediction curves 75 are based on a plurality of combinations of parameters, such as time parameters, that may be stored in a memory, such as memory 72 or memory 74, associated with a particular ink reservoir, such as one of ink reservoirs 30, 32 that in some embodiments may be integral with printheads 26, 28, respectively. The evaporation prediction curves 75 assume no ejection of ink from the ink reservoir.

In the exemplary curves of FIG. 2, various scenarios for evaporation losses are plotted in association with predetermine times, e.g., T0, T1, T2 and T3. Time T0 may be, for example, a time of initial fill of the ink reservoir. Time T1 may be an amount of time, e.g., in months, measured from initial time T0, to when each of the exemplary evaporation prediction curves 75 shown in FIG. 2 is at a first percentage of total yield (T0 Yield), e.g., 85 percent. Time T2 may be an amount of time, e.g., in months, measured from time T1, to when each of the exemplary evaporation prediction curves 75 shown in FIG. 2 is at a second percentage of total yield (T0 Yield), e.g., 67 percent; and time T3 may be an amount of time, e.g., in months, measured from time T2, that it takes for the evaporation curve to go to zero percent of total yield (T0 Yield).

FIG. 3 shows an exemplary evaporation prediction curve 78 (represented by a solid line) established in accordance with the present invention. Evaporation prediction curve 78 is established for an ink reservoir so that it approximately tracks an empirical evaporation curve 76 (represented by a dashed line) associated with an ink reservoir type, wherein the ink reservoir being considered is of that ink reservoir type. As an example, times T1, T2 and T3 may be represented in memory 72 corresponding to color ink reservoir 30, or memory 74 of corresponding monochrome ink reservoir 32, by three binary bits in memory, e.g., 12 months=101b, 6 months=010b, 4 months=001b, and 2 months=000b. The approximation of empirical evaporation curve 76 is achieved by dividing the associated empirical evaporation curve 76 into consecutive time segments, e.g., T0 to T1, T1 to T2+T1, and T2+T1 to T3+T2+T1, and then associating a rate of evaporation to each of the segments. Thus, for example, the time segments may extend from an initial time T0, prior to any evaporation loss, to a final time (e.g., T3+T2+T1) when the evaporation loss would deplete a usable supply of ink in the ink reservoir. The rate of evaporation for each of the time segments may be represented, for example, by a respective algorithm, such as for example, linear equations, as more fully described below.

Memory 72 associated with color printhead 26 and/or color ink reservoir 30 may include, for example, thirty-two or more bits reserved for an identification number for color printhead 26 and/or color ink reservoir 30, which may be set by the manufacturer or generated randomly upon installation in imaging apparatus 10; eight or more bits may be used as a usage gauge to maintain a record of usage of color printhead 26 and/or color ink reservoir 30, with each bit representing a level of depletion of ink from color ink reservoir 30; and four or more sets of time bits, represented for example as T0*c*, T1*c*, T2*c* and T3*c*, each including three or more time tracking bits, that may be used to represent time. The letter "c" is used for convenience to designate that the time is associated with a color ink reservoir, and corresponds to times T0, T1, T2 and T3 shown in FIGS. 2 and 3.

By attaching memory 72 to color printhead 26 and/or color ink reservoir 30, in essence, information stored in memory 72 associated with color printhead 26 and/or color ink reservoir 30 travels, respectively, with color printhead 26 and/or color ink reservoir 30 from one imaging apparatus to another. Alternatively, time information, such as one or more of times T0*c*, T1*c*, T2*c* and T3*c*, may be stored in host 8 or imaging apparatus 10.

Memory 74 of monochrome printhead 28 and/or monochrome ink reservoir 32 may include for example, thirty-two or more bits reserved for an identification number for monochrome printhead 28 and/or monochrome ink reservoir 32, which may be set by the manufacturer or generated randomly upon installation in imaging apparatus 10; eight or more bits may be used as a usage gauge to maintain a record of usage of monochrome printhead 28 and/or monochrome ink reservoir 32 with each bit representing a level of depletion of ink from monochrome ink reservoir 32; and four or more sets of time bits, represented by T0*m*, T1*m*, T2*m* and T3*m*, each including three or more time tracking bits, that may be used to represent time. The letter "m" is used for convenience to designate that the time is associated with a monochrome ink reservoir, and corresponds to times T0, T1, T2 and T3 shown in FIGS. 2 and 3.

By attaching memory 74 to monochrome printhead 28 and/or monochrome ink reservoir 32, in essence, information stored in memory 74 associated with monochrome printhead 28 and/or monochrome ink reservoir 32 travels, respectively, with monochrome printhead 28 and/or monochrome ink reservoir 32 from one imaging apparatus to another. Alternatively, time information, such as one or more of times T0*m*, T1*m*, T2*m* and T3*m*, may be stored in host 8 or imaging apparatus 10.

Figure 4:
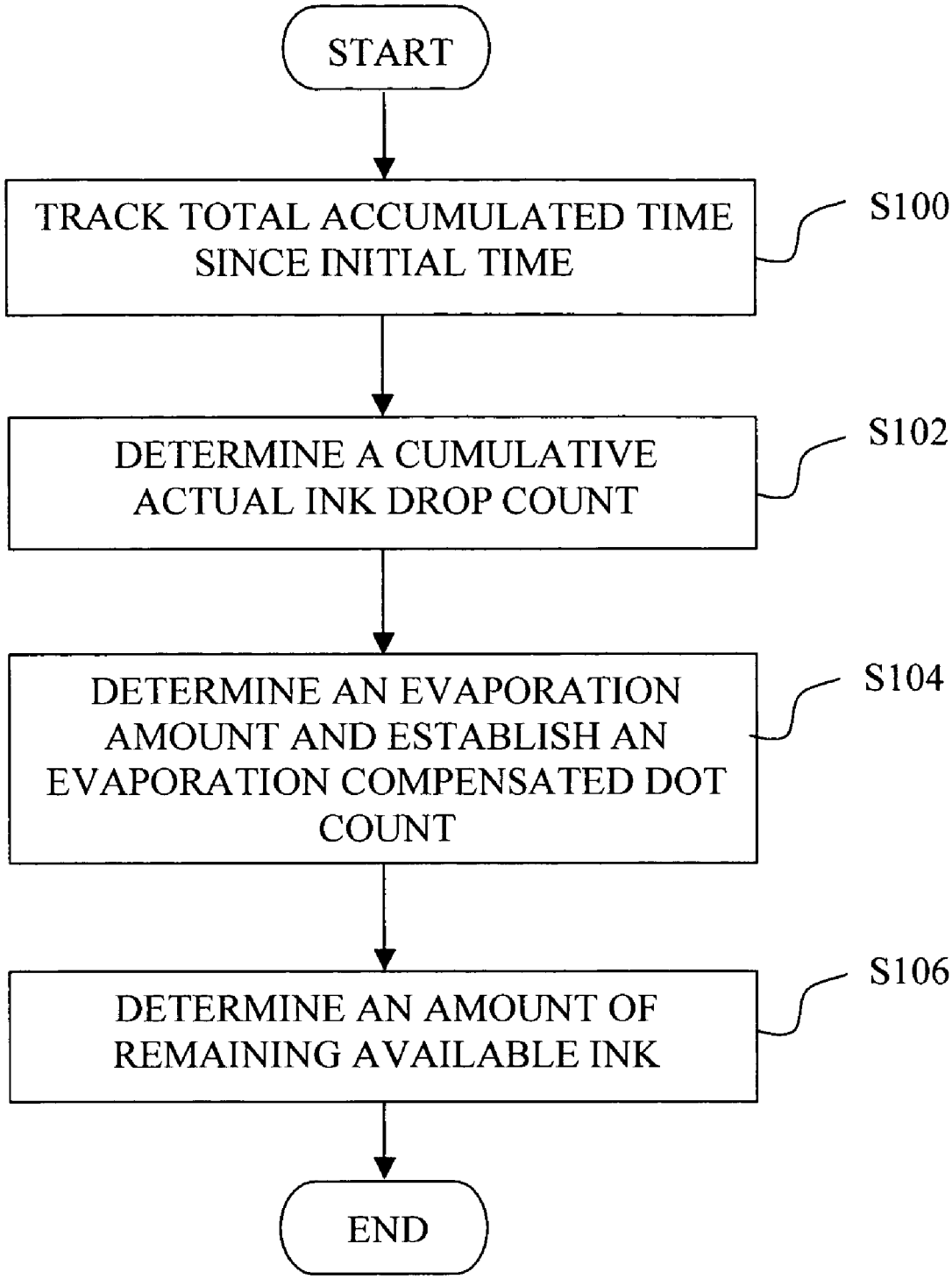
FIG. 4 is a general flowchart of a method that estimates an amount of ink contained in an ink reservoir.

FIG. 4 is a general flowchart of a method that estimates an amount of ink contained in an ink reservoir. It is to be understood that the discussion that follows applies to either of color printhead 26 and/or color ink reservoir 30, or monochrome printhead 28 and/or monochrome ink reservoir 32, as discrete components or when integrated into a unitary printhead cartridge. However, for convenience and ease of understanding, the description of the invention that follows will be directed to an example using monochrome printhead 28 and/or monochrome ink reservoir 32. Further, the previous identified time designations for the monochrome implementation, i.e., T0*m*, T1*m*, T2*m*, T3*m*, simply will be referred to using the general time designations T0, T1, T2, and T3.

At step S100, time is tracked since the initial fill, or refilling, of ink reservoir 32, or the installation of ink reservoir 32 in imaging apparatus 10. This may be performed by controller 18 and/or host 8 by determining an initial time T0 for ink reservoir 32, tracking a total accumulated time period Tt since the initial time T0, and comparing the total accumulated time period Tt to a time threshold, such as for example, time T1. In one embodiment, for example, time T1 may be at least three months.

To obtain the total time the printhead associated with ink reservoir 32 has been in operation, several implementations are possible. One would be write an initial value Tt into memory 74, and increment value Tt over time.

Another possibility would be to write the host date into memory 74 at the time of installation of printhead 28 and/or ink reservoir 32. For example, in one embodiment that utilizes host 8, to calculate time, host 8 may send an NPA Ext Inkjet Cartridge Information command to controller 18 of imaging apparatus 10 that contains the host's date and the identification (ID) of the host. The host date may be, for example, a 16-bit value defined as the number of days since Jan. 1, 2001. The NPA command can be sent prior to every print job, following an NPA Start Job command. Firmware in controller 18 of imaging apparatus 10 uses the date in the current NPA command to calculate the difference in time (delta) since the last NPA command. The total accumulated time Tt since printhead installation may be stored in the memory, such as memory 74, associated with the ink reservoir in a time parameter T4, which is written by the firmware.

Total accumulated time Tt may be represented, for example, by a six bit binary array, with each bit of T4 representing, for example, one months or 30 days. Therefore, when the total accumulated time increases by 30 days, another fuse will be blown in T4.

Alternatively, host 8 could send the date and the host ID to imaging apparatus 10 in the print job start header information, rather than use an NPA command. If imaging apparatus 10 records a time from the print header of a print job that is less than a previous recorded time, imaging apparatus 10 will reset the current time only if the Host ID for the current job is the same as the Host ID for the previous job.

As a further alternative, if a real time clock (RTC) is used, the install date loaded into memory, such as memory 74, would yield the total time Tt since installation. For more robustness, two dates could be loaded into memory 74: 1) the install date and 2) the date when ink reservoir 32 went empty. The subtraction of the two dates would document the length of time printhead 28 and/or ink reservoir 32 was in operation based on relative dates in case the RTC time is significantly different than world time.

The firmware in imaging apparatus 10 may, for example, keep a record of the last used monochrome, color dye, and color pigmented ink reservoirs and/or printheads. The record may include the total dot counts, and the total accumulated time since installation. For example, if a monochrome printhead cartridge is replaced with a color pigmented printhead cartridge, the dot count and the accumulated time for the monochrome printhead cartridge may be stored in the memory. Thus, when the monochrome printhead cartridge is returned to replace the color pigmented printhead cartridge, the monochrome printhead cartridge may be treated just as if it had not been removed.

If a printhead and/or ink reservoir is installed with a blank identification (ID), then imaging apparatus 10 recognizes the printhead and/or ink reservoir as being new and will read the parameters, e.g., T0 Yield, T0, T1, T2, and T3 from the memory associated with the printhead and/or ink reservoir. These parameters may be stored in the memory associated with the ink reservoirs, for example, during a manufacturing operation. The total dot count and the total accumulated time Tt locations in memory 74 will be set to zero.

Further, if a printhead and/or ink reservoir is newly installed with a non-blank ID, but has not been recorded by the firmware of controller 18, then the firmware may use the total dot count stored in the memory associated with the newly installed printhead and/or ink reservoir. Any remainder dot counts in memory of the last printhead and/or ink reservoir installed of that type may also be added to the total dot counts of the newly installed printhead. However, the total accumulated time will be set to the value in T4 of memory 74.

At step 102, a cumulative actual ink drop count of ink drops expelled from ink reservoir 32 is determined. Each drop, or dot, jetted from printhead 28 is counted by controller 18, or alternatively host 8, as ink is used from ink reservoir 32. The ink usage may be tracked by setting a bit in the ink usage gauge array of memory 74 when the accumulated count counted by controller 18, or alternatively host 8, reaches the next usage gauge threshold boundary. For example, usage threshold boundaries may be established in the ink usage array of memory 74 to represent 1,000,000 dots each, and an additional usage bit is set as each threshold boundary is reached. Thus, the cumulative actual ink drop count of ink drops may be maintained in memory 74, or may be maintained in controller 18, or alternatively host 8, by retrieving ink usage information from memory 74.

At step S104, an evaporation amount associated with the ink reservoir, such as ink reservoir 32, is determined in accordance with an embodiment of the present invention, and a compensated drop count is established. The details of determining the evaporation amount in step S104 will be provided following this discussion of the general method. In summary, however, the evaporation amount may be represented by evaporation prediction curve 78 of FIG. 3. Referring to FIG. 3, before time threshold T1, a first rate of evaporation is used. Upon reaching time T1, another rate of evaporation is used. Upon reaching accumulated time T1+T2, still another rate of evaporation is used. For example, upon reaching time threshold T1, i.e., if the total accumulated time period Tt is equal to or greater than time threshold T1, then a second rate of evaporation is used to compensate for an evaporation loss for ink reservoir 32 by adjusting the cumulative actual ink drop count to form an evaporation compensated drop count.

More particularly, for example, the rate of evaporation is used to calculate the amount of ink loss from ink reservoir 32 due to ink evaporation. The ink loss due to the evaporation amount is converted to an equivalent ink drop count, wherein the sum of the cumulative actual ink drop count is added to the equivalent ink drop count to form the evaporation compensated drop count. When the evaporation compensated drop count reaches the next usage threshold boundary, the next bit in the usage gauge in memory 74 associated with ink reservoir 32 will be set.

At step S106, by knowing the evaporation compensated drop count, e.g., the sum of the cumulative actual ink drop count and the evaporation equivalent ink drop count, as well as the initial drop count (estimated) at initial time T0, i.e., when ink reservoir 32 is full, then an amount of remaining ink available from ink reservoir 32 can be readily determined by subtracting the evaporation compensated drop count from the initial drop count.

Figure 5:
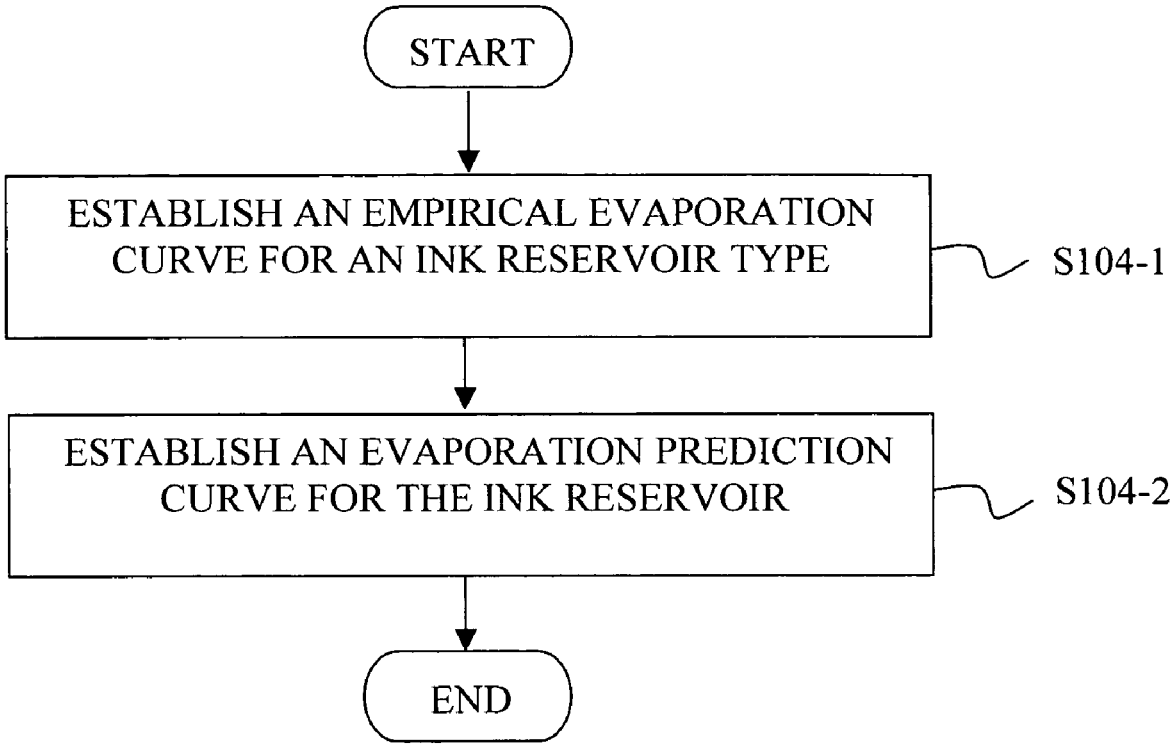
FIG. 5 is a flowchart of a method that may be utilized in implementing an evaporation amount determination act of the method of FIG. 4.

FIG. 5 is a flowchart of a method that may be utilized in implementing the act of determining the evaporation amount in step S104 of FIG. 4.

At step S104-1, an empirical evaporation curve is established for an ink reservoir type. Referring to FIG. 3, empirical data is collected by making evaporation measurements relating to a particular ink reservoir type to establish empirical evaporation curve 76 for the ink reservoir type. The ink reservoir type may be identified, for example, based on the ink type (e.g., color, monochromatic, pigment, dye, dilute, etc.), fluid capacity, and configuration. For example, color ink reservoir 30 may be associated with one ink reservoir type, whereas monochrome ink reservoir 32 may be associated with another ink reservoir type. The empirical evaporation curve 76 for the ink reservoir type may be maintained at the manufacturing site, or alternatively, may be stored in the memory to be associated with an ink reservoir belonging to that ink reservoir type. For example, an empirical evaporation curve for a particular monochrome ink reservoir type may be stored in memory 74 associated with monochrome ink reservoir 32, and may be stored in the form of a look-up table.

At step S104-2, an evaporation prediction curve 78 is established for the ink reservoir, such as for example monochrome ink reservoir 32, that approximates, e.g., approximately tracks, empirical evaporation curve 76. The act of approximating empirical evaporation curve 76 can be performed by changing a slope of the evaporation prediction curve at predetermined points in time, e.g., T1, T2+T1, and T3+T2+T1, as shown in FIG. 3, to approximate a slope of the empirical evaporation curve 76. Time values for T0, T1, T2 and T3 may be stored in the memory, e.g., memory 74, associated with the ink reservoir, e.g., monochrome ink reservoir 32. Thus, as shown in the example of FIG. 3, the rate of change in the slope of evaporation prediction curve 78, i.e., the rate of evaporation, changes as time increases. More particularly, the slope i.e., rate of evaporation, of the evaporation prediction curve at time T0 in FIG. 3 is selected to correspond generally to the slope of a corresponding portion of a empirical evaporation curve 76, e.g., from time T0 to time T1. The slope, i.e., rate of evaporation, of the evaporation prediction curve 78 at time T1 in FIG. 3 is selected to correspond generally to the slope of a corresponding portion of empirical evaporation curve 76, e.g., from time T1 to time T2+T1. The slope, i.e., rate of evaporation, of the evaporation prediction curve 78 at time T2+T1 in FIG. 3 is selected to correspond generally to the slope of a corresponding portion of empirical evaporation curve 76, e.g., from time T2+T1 to time T3+T2+T1.

Thus, by utilizing multiple rates of evaporation in establishing evaporation prediction curve 78, evaporation prediction curve 78 more closely tracks the profile, e.g., slope, of the corresponding portion of empirical evaporation curve 76 than would have been the case if a single straight line approximation of evaporation was used.

In the example shown in FIG. 3, at time T1, the amount of ink was determined to be about 85 percent of the initial claimed yield T0 Yield designated by evaporation prediction curve 78 at time T0. At time T2+T1, the amount of ink was determined to be about 67 percent of the initial claimed yield T0 Yield designated by ink evaporation prediction curve 78 at time T0. At time T3+T2+T1, evaporation prediction curve 78 will go to zero.

In specific example that follows, the firmware in controller 18 will use the date information to calculate the change in time, e.g., delta time, since the last print job. The firmware will begin determining, e.g., accumulating, an amount of evaporated ink using the equations:

$$\text{rate} = -\frac{T0\ \text{Yield} * 0.15}{T1}$$

$$\text{Yield} = \text{rate} * Time_{current} + T0\ \text{Yield}$$

wherein:

rate is the rate of evaporation;

T0Yield is the total yield of the ink reservoir, e.g., ink reservoir 32, at time T0;

T1 is a first length of time measured from the time T0;

$Time_{current}$ is the total accumulated time Tt; and

Yield is the ink evaporation amount, i.e., loss, of the ink reservoir.

When the delta time reaches time T1, the firmware will begin determining, e.g., accumulating, an amount of evaporated ink using the equations:

$$\text{rate} = -\frac{T0\ \text{Yield} * 0.18}{T2}$$

$$\text{Yield} = \text{rate} * Time_{current} - \frac{T0\ \text{Yield} * (T1 * 0.67 - (T2 + T1) * 0.85)}{T2}$$

wherein:

rate is the rate of evaporation;

T0 Yield is the total yield of the ink reservoir, e.g., ink reservoir 32, at time T0;

T1 is a first length of time measured from the time T0;

T2 is a second length of time measured from time T1;

T2+T1 is the sum of times T1 and T2 (see, for example, FIG. 3);

$Time_{current}$ is the total accumulated time Tt; and

Yield is the ink evaporation amount of the ink reservoir.

When the delta time reaches time T2+T1, the firmware will begin determining, e.g., accumulating, an amount of evaporated ink using the equations:

$$\text{rate} = -\frac{T0\ \text{Yield} * 0.67}{T3}$$

$$\text{Yield} = \text{rate} * Time_{current} + \frac{T0\ \text{Yield} * ((T3 + T2 + T1) * 0.67)}{T3}$$

wherein:

rate is the rate of evaporation;

T0 Yield is the total yield of the ink reservoir, e.g., ink reservoir 32, at time T0;

T1 is a first length of time measured from the time T0;

T2 is a second length of time measured from time T1;

T3 is a third length of time measured from time T2;

T3+T2+T1 is the sum of times T1, T2 and T3 (see, for example, FIG. 3);

$Time_{current}$ is the total accumulated time Tt; and

Yield is the ink evaporation amount of the ink reservoir.

In embodiments utilizing host 8, in case the host computer's time becomes incorrect, the maximum delta in the rate of evaporation may be based on a maximum delta time e.g., a delta time of two weeks. For example, if the rate of evaporation is 200 pages/month and the delta time calculated is 3 months, then the evaporation may be limited to 100 pages. However, the time may be set based on the time read from the print header even if the delta in time is greater than two weeks.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of ink evaporation prediction for an ink reservoir, comprising:

establishing an empirical evaporation curve that extends over a plurality of months representing evaporation characteristics for an ink reservoir type, said ink reservoir belonging to said ink reservoir type;

establishing an evaporation prediction curve for said ink reservoir that approximates said empirical evaporation curve over said plurality of months; and using said evaporation prediction curve to determine an amount of remaining available ink in said ink reservoir.

2. The method of claim 1, wherein an act of approximating said empirical evaporation curve is performed by changing a slope of said evaporation prediction curve at predetermined points in time after five months to approximate a slope of said empirical evaporation curve.

3. The method of claim 1, further comprising:

determining an evaporation amount based on said evaporation prediction curve for said ink reservoir; and using said evaporation amount to compensate for an evaporation loss for said ink reservoir by adjusting a cumulative actual ink drop count to form an evaporation compensated drop count.

4. The method of claim 3, wherein said evaporation amount is represented as an equivalent ink drop count, and wherein said evaporation compensated drop count is the sum of said cumulative actual ink drop count and said equivalent ink drop count.

5. The method of claim 1, wherein said ink reservoir is combined with a printhead to form a unitary printhead cartridge.

6. The method of claim 5, wherein said evaporation prediction curve also is associated with said printhead.

7. A method of ink evaporation prediction for an ink reservoir having ink evaporation characteristics represented by an empirical evaporation curve determined for an ink reservoir type, said ink reservoir belonging to said ink reservoir type, said method associating a respective non-zero rate of evaporation to each of a plurality of time segments that respectively extend over a plurality of months and that are associated with said empirical evaporation curve, said respective rate of evaporation being based on a respective approximation algorithm associated with each of said plurality of time segments; and using said ink evaporation prediction to determine an amount of remaining available ink in said ink reservoir.

8. The method of claim 7, wherein said plurality of time segments are consecutive, beginning from an initial time.

9. The method of claim 7, wherein each said respective approximation algorithm associated with each of said plurality of time segments is represented by a linear equation.

10. The method of claim 7, wherein said plurality of time segments extend from an initial time, prior to any evaporation loss, to a final time when said evaporation loss would deplete a usable supply of ink in said ink reservoir.

11. The method of claim 7, said method being performed by a controller in an imaging apparatus.

12. A method of ink evaporation prediction for an ink reservoir having ink evaporation characteristics represented by an empirical evaporation curve determined for an ink reservoir type, said ink reservoir belonging to said ink reservoir type, comprising:

associating a respective non-zero rate of evaporation to each of a plurality of time segments associated with said empirical evaporation curve, said respective rate of evaporation being based on a respective approximation algorithm associated with each of said plurality of time segments;

determining an ink evaporation amount based on said respective rate of evaporation; and using said ink evaporation amount to determine an amount of remaining available ink in said ink reservoir, wherein at an initial time T0, said ink evaporation amount is determined by the equations:

$$\text{rate} = -\frac{T0\ \text{Yield} * 0.15}{T1}$$

$$\text{Yield} = \text{rate} * Time_{current} + T0\ \text{Yield}$$

wherein:

rate is said rate of evaporation;

T0Yield is a total yield of said ink reservoir at said initial time T0;

T1 is a first length of time measured from the time T0;

$Time_{current}$ is a total accumulated time; and

Yield is said ink evaporation amount of said ink reservoir.

13. The method of claim 12, wherein at said time T1, said ink evaporation amount is determined by the equations:

$$\text{rate} = -\frac{T0\ \text{Yield} * 0.18}{T2}$$

$$\text{Yield} = \text{rate} * Time_{current} - \frac{T0\ \text{Yield} * (T1 * 0.67 - (T2 + T1) * 0.85)}{T2}$$

wherein T2 is a time measured from time T1.

14. The method of claim 13, wherein at a time corresponding a sum of times T1 and T2, said ink evaporation amount is determined by the equations:

$$\text{rate} = -\frac{T0\ \text{Yield} * 0.67}{T3}$$

$$\text{Yield} = \text{rate} * Time_{current} + \frac{T0\ \text{Yield} * ((T3 + T2 + T1) * 0.67)}{T3}$$

wherein T3 is a time measured from time T2.

15. The method of claim 12, wherein said ink evaporation amount is represented as an equivalent ink drop count.

16. A printhead comprising:

memory, wherein said memory stores parameters associated with an evaporation prediction curve for an ink reservoir, said evaporation prediction curve having a plurality of time segments that respectively extend over a plurality of months, each of said plurality of time segments having a respective non-zero slope that approximates an empirical evaporation curve, and wherein a printer in which the printhead is installed executes instructions to:

determine an evaporation amount based on said evaporation prediction curve for said ink reservoir; and use said evaporation amount to compensate for an evaporation loss for said ink reservoir over a period of months by adjusting a cumulative actual ink drop count to form an evaporation compensated drop count.

17. The printhead of claim 16, wherein said printhead and said ink reservoir are combined as a unitary printhead cartridge.

18. A printhead comprising:

memory, wherein said memory stores parameters associated with an evaporation prediction curve for an ink reservoir, said evaporation prediction curve having a plurality of time segments, each of said plurality of time segments having a respective non-zero slope that approximates an empirical evaporation curve, and wherein a printer in which the printhead is installed executes instructions to:

determine an ink evaporation amount based on said evaporation prediction curve for said ink reservoir; and use said ink evaporation amount to compensate for an evaporation loss for said ink reservoir by adjusting a cumulative actual ink drop count to form an evaporation compensated drop count, wherein at an initial time T0, said ink evaporation amount is determined by the equations:

$$\text{rate} = -\frac{T0\ \text{Yield} * 0.15}{T1}$$

$$\text{Yield} = \text{rate} * \text{Time}_{Current} + T0\ \text{Yield}$$

wherein:

rate is said rate of evaporation;

T0Yield is a total yield of said ink reservoir at said initial time T0;

T1 is a first length of time measured from the time T0;

$\text{Time}_{current}$ is a total accumulated time; and

Yield is said ink evaporation amount of said ink reservoir.

19. The printhead of claim 18, wherein at said time T1, said ink evaporation amount is determined by the equations:

$$\text{rate} = -\frac{T0\ \text{Yield} * 0.18}{T2}$$

-continued $$\text{Yield} = \text{rate} * \text{Time}_{Current} - \frac{T0\ \text{Yield} * (T1 * 0.67 - (T2 + T1) * 0.85)}{T2}$$

wherein T2 is a time measured from time T1.

20. The printhead of claim 19, wherein at a time corresponding a sum of times T1 and T2, said ink evaporation amount is determined by the equations:

$$\text{rate} = -\frac{T0\ \text{Yield} * 0.67}{T3}$$

$$\text{Yield} = \text{rate} * \text{Time}_{Current} - \frac{T0\ \text{Yield} * ((T3 + T2 + T1) * 0.67)}{T3}$$

wherein T3 is a time measured from time T2.

* * * * *